US010522120B2

(12) United States Patent
Suenaga

(10) Patent No.: US 10,522,120 B2
(45) Date of Patent: Dec. 31, 2019

(54) KEY UNIT AND WIND INSTRUMENT

(71) Applicant: YAMAHA CORPORATION, Hamamatsu-shi (JP)

(72) Inventor: Yuichiro Suenaga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/117,790

(22) Filed: Aug. 30, 2018

(65) Prior Publication Data

US 2018/0374458 A1 Dec. 27, 2018

Related U.S. Application Data

(63) Continuation of application No. PCT/JP2017/007718, filed on Feb. 28, 2017.

(30) Foreign Application Priority Data

Mar. 7, 2016 (JP) ..... 2016-043811

(51) Int. Cl.
*G10D 9/04* (2006.01)
*G10D 7/06* (2006.01)

(52) U.S. Cl.
CPC ..... *G10D 9/043* (2013.01); *G10D 7/06* (2013.01); *G10D 9/04* (2013.01)

(58) Field of Classification Search
CPC ..... G10D 9/043; G10D 9/04; G10D 7/06
USPC ..... 84/380 R
See application file for complete search history.

(56) References Cited

U.S. PATENT DOCUMENTS 329,940 A * 11/1885 Oesterle ..... G10D 9/043 84/380 R
1,586,206 A 5/1926 Loomis
1,844,242 A * 2/1932 Ciccone ..... G10D 7/00 84/385 R
2,234,092 A * 3/1941 Shaw ..... G10D 9/043 84/380 R
2,234,093 A * 3/1941 Silver ..... G10D 9/043 84/380 R
2,330,379 A * 9/1943 Powell ..... G10D 7/023 84/384
2,471,290 A * 5/1949 Sommaruga ..... G10D 7/08 84/385 R (Continued)

FOREIGN PATENT DOCUMENTS

DE 1802028 U 12/1959
EP 0133372 A2 * 2/1985 ..... G10D 9/043

(Continued)

OTHER PUBLICATIONS

International Search Report issued in International Application No. PCT/JP2017/007718 dated Apr. 25, 2017. Englis translation provided.

(Continued)

*Primary Examiner* — Elvin G Enad
*Assistant Examiner* — Christina M Schreiber
(74) *Attorney, Agent, or Firm* — Rossi, Kimms & McDowell LLP

(57) ABSTRACT

A key unit includes: a base portion that is fixable to a musical instrument body that includes a tube body; a key post that projects from the base portion; a key shaft that is attached to the key post; and a key that is attached to the key shaft.

14 Claims, 6 Drawing Sheets

(56) References Cited

U.S. PATENT DOCUMENTS

| | | | | | |
|---|---|---|---|---|---|
| 3,145,610 | A | * | 8/1964 | Anderson | G10D 9/043 84/380 R |
| 3,394,624 | A | * | 7/1968 | Seaman | G10D 9/043 84/382 |
| 3,421,398 | A | | 1/1969 | Whiteside | |
| 3,504,590 | A | * | 4/1970 | Bedford | G10D 9/043 84/380 R |
| 3,583,273 | A | * | 6/1971 | Yokoyama | G10D 9/043 84/380 R |
| 3,657,464 | A | * | 4/1972 | Pascucci | G10D 7/08 84/380 R |
| 4,669,351 | A | * | 6/1987 | Ono | G10D 9/043 84/380 R |
| 5,237,902 | A | * | 8/1993 | Hamanaga | G10D 9/04 251/279 |
| 5,299,486 | A | * | 4/1994 | Weingrill | G10D 9/043 84/380 R |
| 5,477,766 | A | * | 12/1995 | Ellsworth | G10D 9/043 84/382 |
| 5,841,048 | A | * | 11/1998 | Winter | F16B 21/02 84/380 R |
| 5,898,116 | A | * | 4/1999 | Lin | G10D 9/043 84/380 R |
| D574,414 | S | * | 8/2008 | Kenmochi | D17/13 |
| 2003/0024372 | A1 | * | 2/2003 | Nagahara | G10D 9/043 84/380 R |
| 2018/0190245 | A1 | * | 7/2018 | Suenaga | G10D 7/06 |
| 2018/0254026 | A1 | * | 9/2018 | Suenaga | G10D 7/02 |
| 2018/0374458 | A1 | * | 12/2018 | Suenaga | G10D 7/06 |

FOREIGN PATENT DOCUMENTS

| | | | | | |
|---|---|---|---|---|---|
| GB | 717902 | A | | 11/1954 | |
| GB | 2202074 | A | * | 9/1988 | G10D 7/005 |
| JP | S6030493 | U | | 3/1985 | |
| JP | S6030494 | U | | 3/1985 | |
| JP | H02502945 | A | | 9/1990 | |
| JP | 2004191456 | A | * | 7/2004 | |
| JP | 2004191456 | A | | 7/2004 | |
| JP | 2004325981 | A | * | 11/2004 | |
| JP | 2004325981 | A | | 11/2004 | |
| WO | 8807252 | A1 | | 9/1988 | |

OTHER PUBLICATIONS

Written Opinion issued in International Application No. PCT/JP2017/007718 dated Apr. 25, 2017.

Extended European Search Report issued in European Appln. No. 17763003.5 dated Oct. 1, 2019.

* cited by examiner

KEY UNIT AND WIND INSTRUMENT

PRIORITY CLAIM

This application is continuation application of a PCT Application No. PCT/JP2017/007718, filed Feb. 28, 2017, entitled "KEY UNIT AND WIND INSTRUMENT" whose priority is claimed on Japanese Patent Application No. 2016-043811, filed on Mar. 7, 2016. The description thereof is incorporated herein by reference.

BACKGROUND OF THE INVENTION

Field of the Invention

The present invention is related to a key unit and a wind instrument provided with same.

Description of Related Art

Some wind instruments are equipped with a key system (key mechanism) for opening and closing tone holes formed in a tube body, as disclosed in, for example, Japanese Unexamined Patent Application Publication No. 2004-191456 and Japanese Unexamined Patent Application Publication No. 2004-325981. The key system includes a plurality of key posts attached to the tube body, a key shaft attached to the key posts, and a key attached to the key shaft.

In the above-described conventional wind instrument, the key posts are directly fixed to the tube body by screws or soldering. For this reason, it is troublesome to attach and detach the key system to/from the tube body.

When attaching the key system to the tube body, since the key shaft and key are attached to the key posts after fixing the key posts to the tube body, adjustment of the positioning of the key posts, the key shaft and the key with respect to the tube body is troublesome. Specifically, in order to attach the key and the key shaft to key posts that have been fixed to the tube body, it is necessary to adjust the position and orientation of each key post holding the key shaft with high accuracy. Also, when attaching a key or key shaft between the two key posts, it is necessary to adjust the position of the two key posts so that their insertion holes for attaching the key shaft are coincide with each other, and adjust the length of the key shaft to match the interval between the two key posts with high accuracy. Furthermore, after attaching the key, it is necessary to adjust the position of the key with respect to the tone hole with high accuracy.

When removing the key or key shaft from the key posts, it is particularly necessary to carry out the work with care so as not to damage the key posts.

SUMMARY OF THE INVENTION

The present invention has been made in view of the abovementioned circumstances, and has as its object to provide a key unit that enables a key post, key shaft, and key to be easily attached to and detached from a tube body, and a wind instrument that is provided with the key unit.

The present invention provides a key unit including a base portion that is fixable to a musical instrument body that includes a tube body; a key post that projects from the base portion; a key shaft that is attached to in the key post; and a key that is attached to the key shaft.

Also, the present invention provides a wind instrument including a musical instrument body including a tube body and a key unit that is detachably attached to the musical instrument body, in which the key unit includes a base portion that is fixed to the musical instrument body, a key post that projects from the base portion, a key shaft that is attached to the key post, and a key attached to the key shaft.

EMBODIMENTS FOR CARRYING OUT THE INVENTION

Hereinbelow, one embodiment of the present invention will be described referring to FIG. 1 to FIG. 5.

Figure 1:
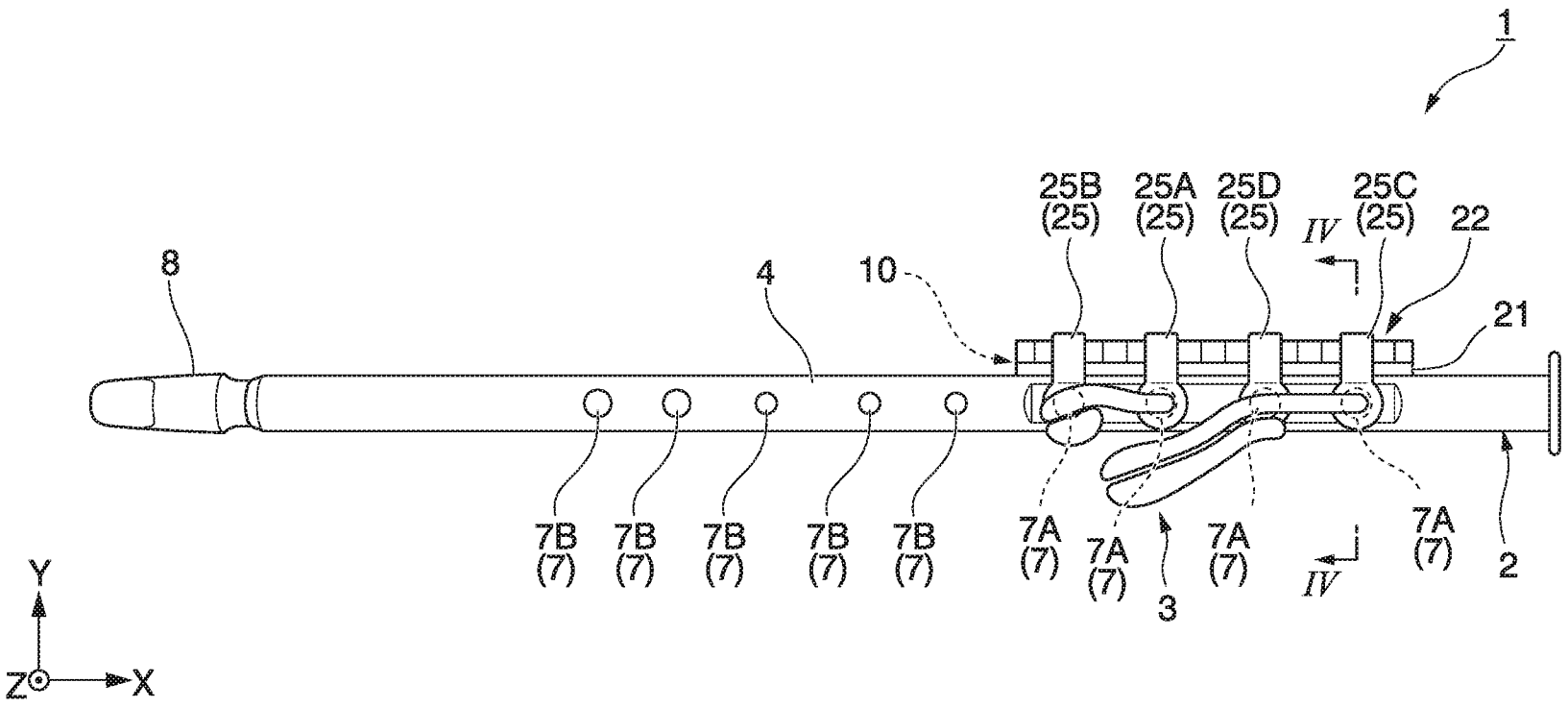
FIG. 1 is a front view showing a wind instrument according to one embodiment of the present invention.

As shown in FIG. 1, a wind instrument 1 of the present embodiment is provided with a musical instrument body 2 and a key unit 3. The musical instrument body 2 is provided with a tube body 4.

The tube body 4 may for example be formed by any one material of a wood material, a metal material, and a resin material, and may for example be formed by a material that suitably combines these materials.

The tube body 4 of the present embodiment is formed in a cylindrical shape. A plurality of tone holes 7 are formed in the tube body 4. The plurality of tone holes 7 are arranged spaced apart in the axial direction of the tube body 4. The plurality of tone holes 7 may all be opened and closed by using for example a key system 22 (described below) of the key unit 3. In the present embodiment, some tone holes 7 (first tone holes 7A) are opened and closed using the key system 22, and the remaining tone holes 7 (second tone holes 7B) are directly opened and closed by the player's fingers.

While there may for example only be one first tone hole 7A, in the present embodiment there are a plurality (four in the illustrated example). In the present embodiment, the plurality of first tone holes 7A are arranged continuously in the longitudinal direction (X-axis direction) of the tube body 4.

A mouthpiece 8 is provided at a first end of the tube body 4 in the axial direction. The mouthpiece 8 may for example be integrally formed with the tube body 4, and may be detachably mounted to the tube body 4. The mouthpiece 8 may for example be an air reed, a lip reed, a single reed, or a double reed. The second end of the tube body 4 in the axial direction opens to the outside. For example, a bell may be provided at the second end of the tube body 4.

In the present embodiment, the longitudinal direction of the tube body 4 corresponds to the straight direction from the mouthpiece 8 to the second end of the tube body 4 as seen from the performer playing the wind instrument 1.

Figure 2:
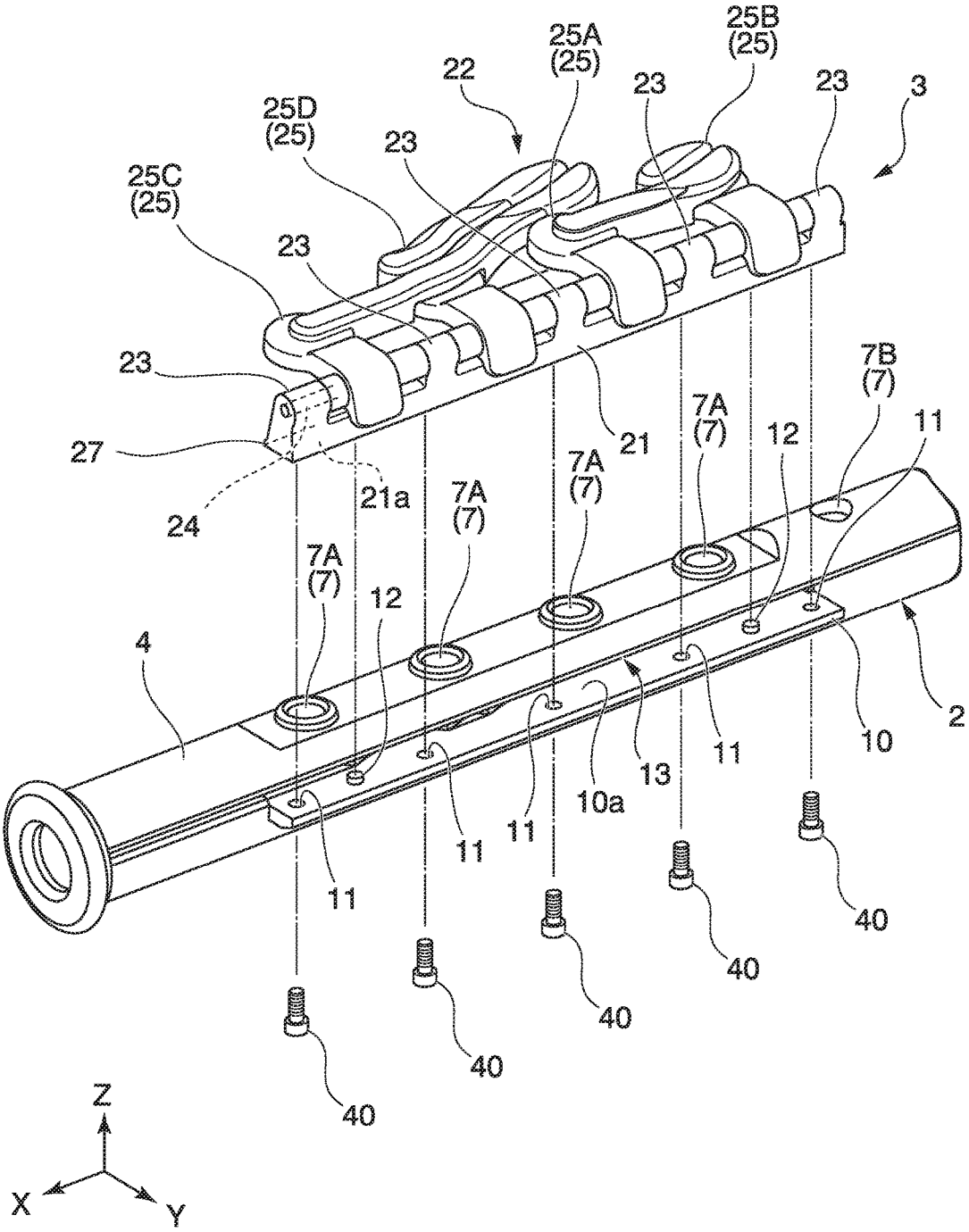
FIG. 2 is a perspective view of the wind instrument of FIG. 1 that shows the state of the key unit removed from the musical instrument body.
Figure 4:
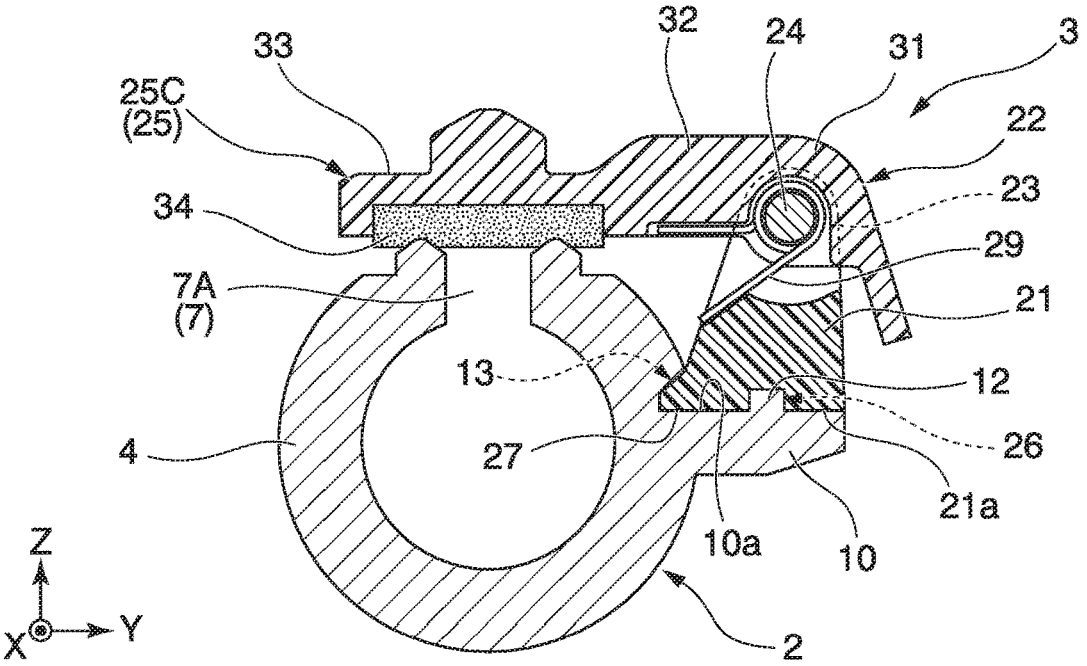
FIG. 4 is a cross-sectional view along arrows IV-IV of FIG. 1.
Figure 5:
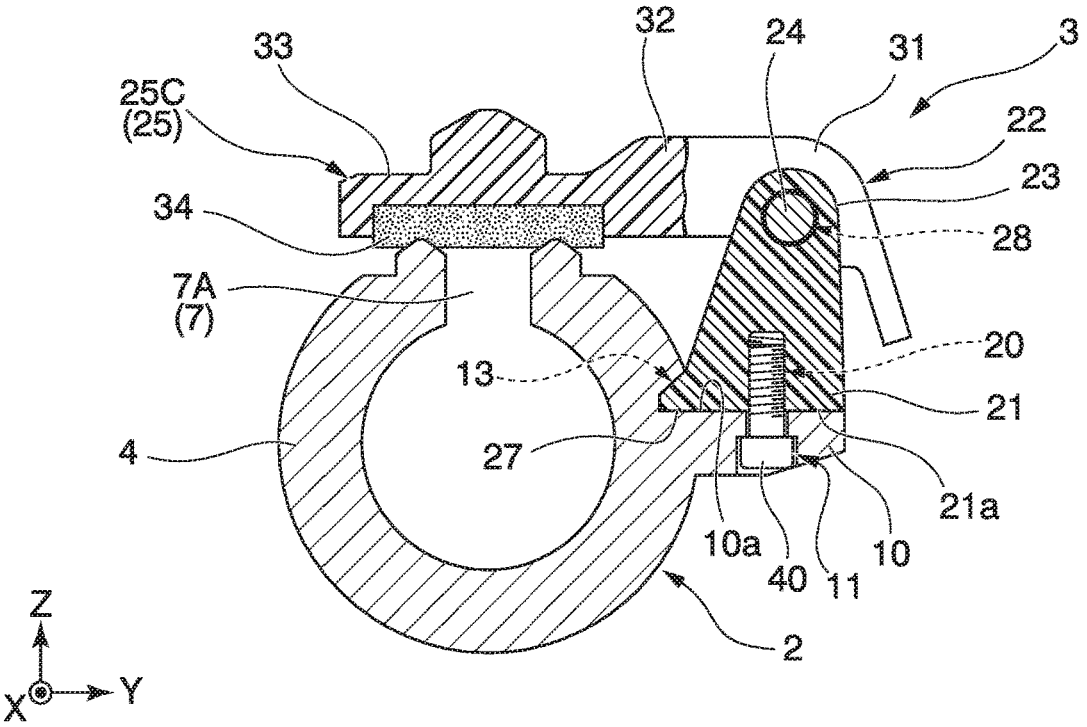
FIG. 5 is a cross-sectional view showing the fixing structure of the key unit and the musical instrument body of FIGS. 1 to 4.

As shown in FIGS. 2, 4, 5, the musical instrument body 2 of the present embodiment is provided with a pedestal portion 10 for installing the key unit 3 to be described later.

The pedestal portion 10 projects from the outer peripheral surface of the tube body 4. In the present embodiment, the pedestal portion 10 projects in a direction (Y-axis direction) orthogonal to the penetration direction (Z-axis direction) of the tone hole 7 in the tube body 4, or in direction close to the direction orthogonal thereto.

The pedestal portion 10 is disposed at a position corresponding to the first tone hole 7A that is opened and closed by using the key system 22 in the longitudinal direction of the tube body 4. While the pedestal portion 10 may for example be individually provided for a plurality of the first tone holes 7A, in the present embodiment only one is provided for the plurality of first tone holes 7A, being formed extending in the arrangement direction of the plurality of first tone holes 7A (X-axis direction).

The pedestal portion 10 has a flat mounting surface 10*a* on which the key unit 3 is mounted. The mounting surface 10*a* may be oriented in an arbitrary direction, but in the present embodiment it is oriented in a direction in which the tone hole 7 opens (Z-axis positive direction) or in a direction close to this direction.

The pedestal portion 10 may for example be formed separately from the tube body 4 and detachably fixed to the tube body 4, but in the present embodiment it is integrally formed with the tube body 4.

As shown in FIG. 2 to FIG. 5, the key unit 3 includes a base portion 21 and a key system 22. The key system 22 includes a key post 23, a key shaft 24, and a key 25.

The base portion 21 can be fixed to the musical instrument body 2. For example, the base portion 21 may be detachably fixed to the outer peripheral surface of the tube body 4. In the present embodiment, the base portion 21 is detachably fixed to the pedestal portion 10.

The base portion 21 has a mounted surface 21*a* in surface contact with the musical instrument body 2 in a state of being fixed to the musical instrument body 2. In the present embodiment, the base portion 21 is disposed on the mounting surface 10*a* of the pedestal portion 10. Therefore, the mounted surface 21*a* of the base portion 21 is in surface contact with the mounting surface 10*a* of the pedestal portion 10. In the present embodiment, the mounted surface 21*a* has the same outer shape as the mounting surface 10*a* of the pedestal portion 10 as viewed in plan view. That is, the base portion 21 is formed to extend in the arrangement direction of the plurality of first tone holes 7A in the same manner as the pedestal portion 10.

The means for fixing the base portion 21 to the musical instrument body 2 (fixing means) may be arbitrary. For example, the fixing means may have a structure that fits together the base portion 21 and the pedestal portion 10. The fixing means of the present embodiment is constituted by a screw 40, a through hole 11 of the pedestal portion 10 that opens to the mounting surface 10*a* of the pedestal portion 10, and the screw hole 20 that opens to the mounted surface 21*a* of the base portion 21. The shaft portion of the screw 40 is inserted through the through hole 11 of the pedestal portion 10 which opens to the mounting surface 10*a* of the pedestal portion 10, and then engages with the screw hole 20 that opens to the mounted surface 21*a* of the base portion 21. As a result, the base portion 21 is fixed to the pedestal portion 10 by the screw 40.

The base portion 21 of the present embodiment has a positioning portion for positioning the key unit 3 with respect to the musical instrument body 2.

In the present embodiment, the positioning portion of the base portion 21 includes a first body engaging portion 26 provided in the mounted surface 21*a*. The first body engaging portion 26 is engaged with a first base engaging portion 12 provided on the mounting surface 10*a* of the pedestal portion 10. In the state in which the first body engaging portion 26 is engaged with the first base engaging portion 12, the base portion 21 is restricted to move in the direction along the mounting surface 10*a* and the mounted surface 21*a* with respect to the pedestal portion 10.

In the illustrated example, the first body engaging portion 26 is an engagement concave portion recessed from the mounted surface 21*a* of the base portion 21, and the first base engaging portion 12 projects from the mounting surface 10*a* to be inserted into the engagement concave portion, but are not limited thereto. For example, the first body engaging portion 26 may be an engagement convex portion projecting from the mounted surface 21*a* of the base portion 21, and the first base engaging portion 12 may be an engagement concave portion recessed from the mounting surface 10*a* of the pedestal portion 10.

The first base engaging portion 12 of the pedestal portion 10 shown in FIG. 2 and the corresponding first body engaging portion 26 of the base portion 21 are provided in a plurality spaced apart from each other. In the illustrated example, the plurality of first base engaging portions 12 and the plurality of first body engaging portions 26 are each arranged in the arrangement direction of the plurality of first tone holes 7A, but the present invention is not limited thereto.

In this way, by providing a plurality (plurality of sets) of positioning portions consisting of the first base engaging portion 12 and the first body engaging portion 26, it is possible to more accurately position the key unit 3 with respect to the musical instrument body 2.

In addition, in the present embodiment, the positioning portion of the base portion 21 includes a second body engaging portion 27 that engages with the tube body 4. The second body engaging portion 27 engages with a second base engaging portion 13 provided in the peripheral surface of the tube body 4. In a state in which the second body engaging portion 27 is engaged with the second base engaging portion 13, the base portion 21 is restricted from separating from the mounting surface 10*a* of the pedestal portion 10.

In the present embodiment, the second base engaging portion 13 is an engagement groove that is recessed from the peripheral surface of the tube body 4 and extends in the longitudinal direction of the tube body 4. The second body engaging portion 27 is a projecting portion that extends in the longitudinal direction of the tube body 4 and is inserted into the engagement groove. The inner surface of a part of the engagement groove is formed to be flush with the mounting surface 10*a* of the pedestal portion 10.

In this configuration, when disposing the base portion 21 on the mounting surface 10*a* of the pedestal portion 10, the base portion 21 can be easily positioned with respect to the mounting surface 10*a* of the pedestal portion 10 in the projection direction of the pedestal portion 10 by causing the second body engaging portion 27 to engage with the second base engaging portion 13. Thereby, it is possible to easily align the first body engaging portion 26 of the base portion 21 with the first base engaging portion 12 of the pedestal portion 10.

The key post 23 projects from the base portion 21. While the key post 23 may for example be formed separately from the base portion 21 and detachably fixed to the base portion 21, in the present embodiment the key post 23 is integrally formed with the base portion 21.

The key post 23 may project in an arbitrary direction from the base portion 21, but in this embodiment projects in a direction opposite to the direction in which the mounting surface 10*a* of the base portion 21 faces (Z-axis positive direction). Thus, in a state in which the base portion 21 is disposed on the mounting surface 10*a* of the pedestal portion 10, the key post 23 projects from the base portion 21 in a direction in which the first tone hole 7A opens (Z-axis positive direction).

An insertion hole 28 for inserting the key shaft 24 is formed in the key post 23. In the present embodiment, the insertion hole 28 penetrates the key post 23. Although the axial direction of the insertion hole 28 may be oriented in an arbitrary direction, in the present embodiment the axial direction faces the arrangement direction of the plurality of first tone holes 7A.

In the present embodiment, a plurality of key posts 23 are arranged at intervals along the arrangement direction of the plurality of first tone holes 7A. The plurality of key posts 23 are provided in the base portion 21 so as to be positioned on both sides of each first tone hole 7A in the arrangement direction of the plurality of first tone holes 7A, in the state of the base portion 21 being fixed to the musical instrument body 2. The axes of the insertion holes 28 are coincident with each other in the plurality of key posts 23.

The key shaft 24 is attached to the key posts 23. In the present embodiment, the key shaft 24 is passed through or inserted into the insertion holes 28 of the plurality of key posts 23.

In the present embodiment, the key shaft 24 is rotatable around the axis of the key shaft 24 with respect to the key posts 23 in a state of being attached to the key posts 23.

The key 25 is attached to the key shaft 24. Specifically, the key 25 is attached to the key shaft 24 so as to be rotatable with respect to the base portion 21 and the key posts 23, with the key shaft 24 serving as the rotation axis.

The key 25 is provided with an attachment portion 31 that is attached to the key shaft 24, an arm portion 32 extending from the attachment portion 31, and a cover portion 33 provided at the distal end of the arm portion 32 to close the first tone hole 7A.

The cover portion 33 has a pad 34 made of felt, animal skin, cork or the like.

In the above embodiment, the key shaft 24 is rotatable about the axis of the key shaft 24 with respect to the key posts 23. However, the key shaft 24 may for example be non-rotatably attached to the key posts 23.

Figure 6:
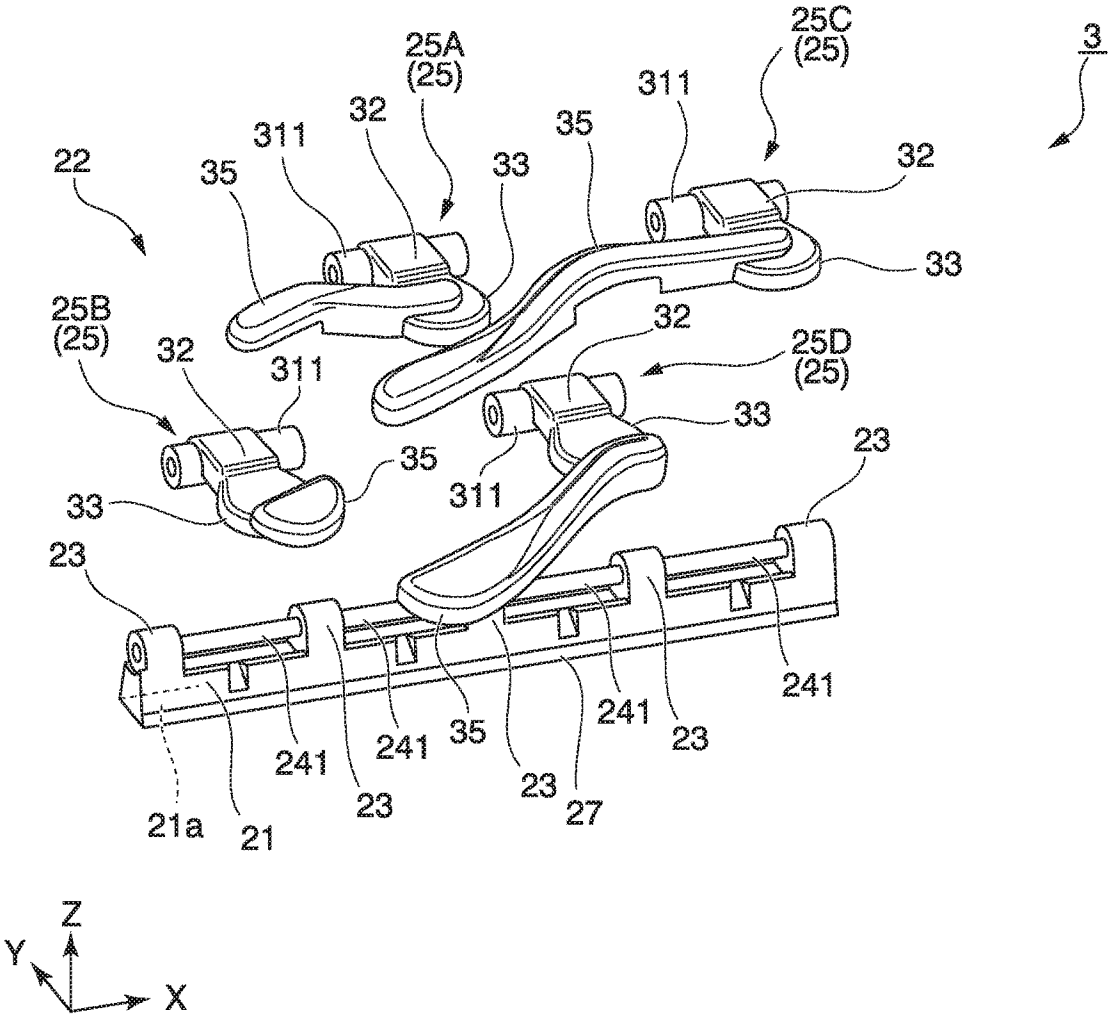
FIG. 6 is an exploded perspective view showing a first modification of the key unit of FIG. 3.

Further, as shown in the first modification of the key unit in FIG. 6, a key shaft 241 may for example be integrally formed with or fixed to the key posts 23. In this case, a linear notch for inserting the key shaft 241 is provided in an attachment portion 311, being formed parallel with the rotation axis thereof, whereby the attachment portion 311 is fitted on the key shaft 241 to be rotatably attached to the key shaft 241. Alternatively, the attachment portion 311 may be split into two along the rotation axis so as to be semi-cylindrical, the key shaft 241 incorporated therein, and then assembled so as to be rotatably attached to the key shaft 241.

In the above embodiment, the attachment portion 31 is formed in a cylindrical shape for inserting the key shaft 24 therethrough. Thereby, the key 25 is rotatably attached to the key shaft 24. However, the key shaft may be rotatably attached to the key posts.

Figure 7:
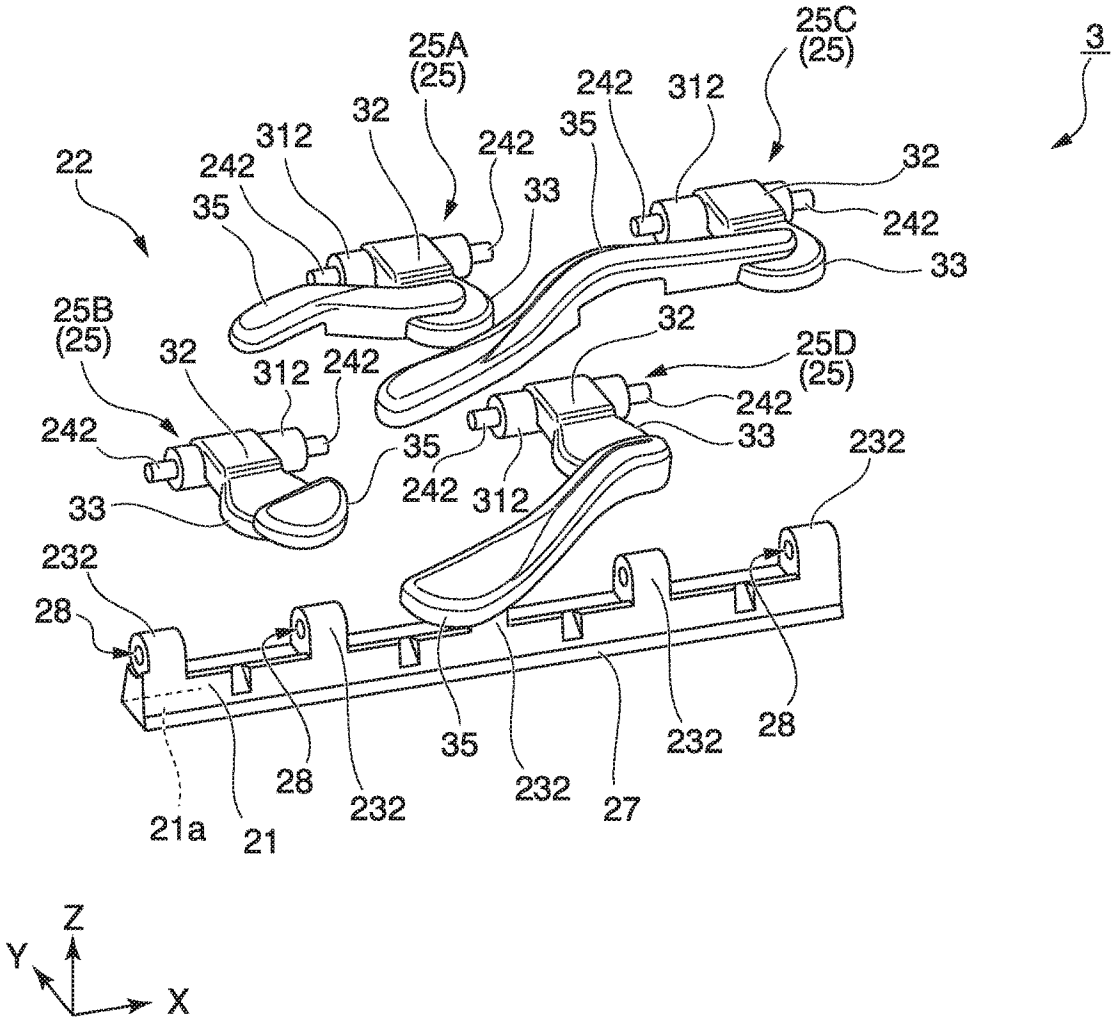
FIG. 7 is an exploded perspective view showing a second modification of the key unit of FIG. 3.

That is, as shown in a second modification of the key unit in FIG. 7, when a key shaft 242 is rotatably attached to key posts 232, an attachment portion 312 may for example be integrally formed with or fixed to the key shaft 242. In this case, the key 25 is rotatable with respect to the key posts 232 together with the key shaft 242. In this case, a notch should be formed in the key posts 232 in the rotation axis direction of the key shaft 242, with the key shaft 242 being fitted therein, whereby the key 25 is rotatably attached to the key posts 232.

In the above embodiment, the attachment portion 31 is disposed between the two adjacent key posts 23.

Figure 3:
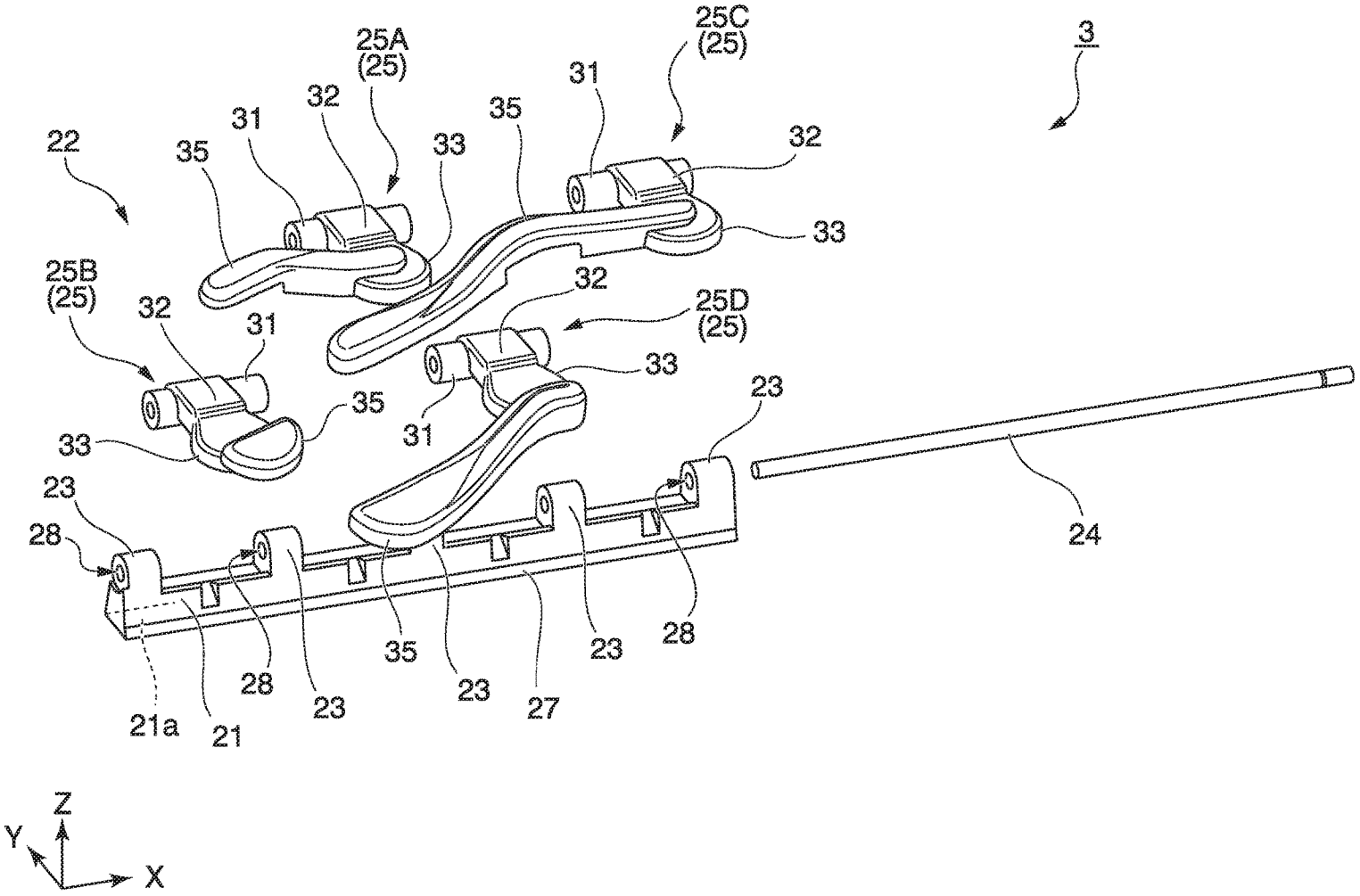
FIG. 3 is an exploded perspective view of the key unit of FIG. 1 and FIG. 2.

However, a configuration is also possible in which the three key posts shown in FIG. 3 sandwiched between the key posts 23 arranged at both ends of the base portion 21 are omitted, and the width of the attachment portion 31 of each of those keys 25 is increased accordingly so that the end portions of the attachment portions 31 in the rotation axis direction make contact with each other to be directly adjacent to each other.

The key 25 attached to the key posts 23 via the key shaft 24 is biased toward one side in the rotational direction with respect to the base portion 21 and the key posts 23 by a biasing member 29.

For example, the biasing member 29 may bias the key 25 so that the cover portion 33 approaches the first tone hole 7A (so as to close the first tone hole 7A), but in the present embodiment, the cover portion 33 biases the key 25 so as to separate from the first tone hole 7A (so as to open the first tone hole 7A). The biasing member 29 may be a torsion spring as shown in the drawing or may be an elastic member such as rubber or the like.

FIGS. 4 and 5 show a state in which the key 25 is pushed to the other side in the rotation direction against the biasing force of the biasing member 29 by the player's finger.

The key 25 of the present embodiment is provided with an operating element 35 for operating the key 25 with the finger of the performer. In the present embodiment, since the biasing member 29 described above biases the key 25 so that the cover portion 33 separates from the first tone hole 7A, the operating element 35 extends from the cover portion 33.

The number of keys 25 corresponds to the number of first tone holes 7A to be opened and closed by the key system 22. That is, the key system 22 of the present embodiment includes a plurality of (four in the illustrated example) keys 25.

In addition, the key system 22 of this embodiment is configured such that by operating a plurality of (two in the illustrated example) cover portions 33 just by operating one operating element 35, a plurality of first tone holes 7A (two in the illustrated example) may be opened and closed.

Specifically, the operator 35 of a first key 25A is disposed so as to overlap the upper side of the cover portion 33 of a second key 25B. Thereby, when the operator 35 of the first key 25A is operated, the cover portion 33 of the first key 25A closes the first tone hole 7A corresponding thereto, and the cover portion 33 of the second key 25B closes the first tone hole 7A corresponding thereto. In the illustrated example, similarly the operator 35 of a third key 25C is disposed so as to overlap the upper side of the cover portion 33 of a fourth key 25D.

As described above, according to the key unit 3 and the wind instrument 1 of the present embodiment, the key posts 23, the key shaft 24 and the keys 25 constituting the key system 22 are attached to each other on the base portion 21. More specifically, the key system 22 is assembled in the state of the key posts 23, the key shaft 24 and the keys 25 being positioned relative to each other. Therefore, the key posts 23, the key shaft 24 and the keys 25 can be collectively attached to and detached from the musical instrument body 2 simply by attaching and detaching the base portion 21 to and from the musical instrument body 2. That is, the key system 22 can be easily attached to and detached from the musical instrument body 2.

More specifically, when detaching the key system 22 from the tube body 4, it is unnecessary to disassemble the key system 22 into the key posts 23, the key shaft 24 and the keys 25 as before. Therefore, the key unit 3 can be easily detached from the musical instrument body 2.

When attaching the key system 22 to the musical instrument body 2, merely by positioning the base portion 21 with respect to the musical instrument body 2, it is possible to easily position the key posts 23, the key shaft 24 and the keys 25 with respect to the musical instrument body 2. In other words, it is possible to easily attach the key posts 23, the key shaft 24 and the keys 25 to the musical instrument body 2 without mutual positioning of the key posts 23, the key shaft 24, the keys 25 and the musical instrument body 2 as before.

As described above, according to the key unit 3 and the wind instrument 1 of the present embodiment, maintenance of the key system 22 can be easily carried out simply by replacing the key unit 3 even without specialized technology.

Further, according to the key unit 3 of the present embodiment, the base portion 21 is provided with a positioning portion for positioning the key unit 3 with respect to the musical instrument body 2. This makes it possible to easily position the key unit 3 with respect to the musical instrument body 2 when attaching the key unit 3 to the musical instrument body 2.

Although the present invention has been described in detail above, the present invention is not limited to the above-described embodiments, and various modifications can be made without departing from the spirit of the present invention.

For example, in the key unit 3 and the wind instrument 1 of the above-described embodiment, when the fixing means for fixing the base portion 21 to the musical instrument body 2 is a structure that fits together the base portion 21 and the musical instrument body 2, the positioning portion provided in the base portion 21 may be constituted by for example an fixing means.

In the key unit of the present invention, provided at least the key is rotatably attached to the base portion and the key post with the key shaft serving as the rotation axis, the key system configuration may be arbitrary. For example, the number of key posts and keys in the key unit is not limited to a plurality and may be one.

In the wind instrument of the present invention, for example, a plurality of key units may be detachably attached to the instrument body. For example, in the instrument body, a key unit operated with the left hand of the performer, a key unit operated with the right hand, and a key unit used as the octave key may be separately attached.

When a plurality of key units are detachably attached to the instrument body, the plurality of key units may be positioned relative to each other so that, for example, the cover portion of the second key unit moves by the key operator of the first key unit. In this case, the key of the first key unit that operates the cover portion of the second key unit may include a cover portion for closing the first tone hole as in the above embodiment, or may not include the cover portion.

According to the present invention, the key post, key shaft and key are mutually attached on the base portion. For this reason, merely by attaching or detaching the base portion to/from the musical instrument body, it is possible to attach and detach the key post, key shaft and key to/from the musical instrument body all at once. That is, the key post, the key shaft and the key can be easily attached to and detached from the musical instrument body.

What is claimed is:

1. A key unit comprising:

a base portion that is discrete from and detachably attachable to a musical instrument body;

a plurality of key posts that project from and integral with the base portion;

at least one key shaft attached to the plurality of key posts; and a plurality of keys attached to the at least one key shaft, wherein the entirety of the base portion, with the attached at least one key shaft and the attached plurality of keys, is attachable to or detachable from the musical instrument body as an assembly.

2. The key unit according to claim 1, wherein the base portion includes a positioning portion for positioning with respect to the musical instrument body.

3. The key unit according to claim 2, further comprising a fixing member provided separately from the positioning portion to fix the base portion to the musical instrument body.

4. The key unit according to claim 1, wherein the base portion includes a plurality of positioning portions for positioning with respect to the musical instrument body.

5. The key unit according to claim 1, wherein each of the at least one key shaft is integrally formed with one of the at least one key.

6. The key unit according to claim 1, wherein the at least one key shaft is integrally formed with the plurality of key posts.

7. A wind instrument comprising:

a tube body; and a key unit comprising:

a base portion discrete from and detachably attached to the tube body;

a plurality of key posts that project from and integral with the base portion;

at least one key shaft attached to the plurality of key posts; and a plurality of keys attached to the at least one key shaft, wherein the entirety of the base portion, with the attached at least one key shaft and the attached plurality of keys, is attachable to or detachable from the tube body as an assembly.

8. The wind instrument according to claim 7, wherein the tube body includes a pedestal portion that projects from an outer peripheral surface of the tube body for fixing the base portion.

9. The wind instrument according to claim 7, wherein the base portion includes a positioning portion for positioning with respect to the tube body.

10. The wind instrument according to claim 9, further comprising a fixing member provided separately from the positioning portion to fix the base portion to the tube body.

11. The wind instrument according to claim 7, wherein the base portion includes a plurality of positioning portions for positioning with respect to the tube body.

12. The wind instrument according to claim 7, wherein each of the at least one key shaft is integrally formed with one of the at least one key.

13. The wind instrument according to claim 7, wherein the at least one key shaft is integrally formed with the plurality of key posts.

14. A key unit comprising:

a base portion that is fixable to a musical instrument body;

a plurality of key posts that project from and integral with the base portion;

at least one key shaft attached to the plurality of key posts;

at least one key attached to the at least one key shaft;

a positioning portion integral with the base portion for positioning with respect to the musical instrument body; and a fixing member provided separately from the positioning portion for fixing the base portion to the musical instrument body.

* * * * *